United States Patent [19]

Kano et al.

[11] Patent Number: 4,824,030

[45] Date of Patent: Apr. 25, 1989

[54] JET AIR FLOW CRUSHER

[75] Inventors: Osamu Kano, Tokorozawa; Yukiyoshi Yamada, Hiki; Shigemi Fujisawa, Kawagoe; Masayuki Yasuguchi, Sagamihara, all of Japan

[73] Assignees: Nisshin Flour Milling Co., Ltd.; Nisshin Engineering Co., Ltd., both of Tokyo, Japan

[21] Appl. No.: 90,667

[22] Filed: Aug. 28, 1987

[30] Foreign Application Priority Data

Sep. 12, 1986 [JP] Japan ..... 61-215346

[51] Int. Cl.[4] ..... B02C 19/06

[52] U.S. Cl. ..... 241/39; 241/79.1; 241/80

[58] Field of Search ..... 241/5, 39, 40, 97, 80, 241/79.1

[56] References Cited

U.S. PATENT DOCUMENTS

| | | | |
|---|---|---|---|
| 2,735,626 | 2/1956 | Trost | 241/39 |
| 3,491,953 | 1/1970 | Stephanoff | 241/39 |
| 3,937,405 | 2/1976 | Stephanoff | 241/39 |
| 4,219,164 | 8/1980 | Taylor | 241/39 |

*Primary Examiner*—Mark Rosenbaum

*Attorney, Agent, or Firm*—Wenderoth, Lind & Ponack

[57] ABSTRACT

A jet air flow crusher has a guide face formed by the inside surface of an outer wall in which a flat and almost ellipsoidal internal space is defined to guide an ellipsoidal gas phase flow powder grains; a crushing zone in which flowing powder grains are crushed provided on one side of the internal space in the direction of the ellipsoidal major axis; a classifying zone at which flowing powder grains are discharged provided on the other side of the internal space in the direction of the ellipsoidal major axis; a gas phase flow passage defined in the crushing zone by the inside surface of the outer wall and a partition wall; nozzles installed in the outer wall and the partition wall at several locations in the direction of the powder grain flow in the crushing zone to jet out air in a direction substantially corresponding to the powder grain flow for carrying and crushing the powder grains, and flow resisting means for limiting the gas phase flow carrying the powder grains, arranged at least at one location between the nozzles spaced from one another in the direction of the powder grain flow.

2 Claims, 6 Drawing Sheets

JET AIR FLOW CRUSHER

BACKGROUND OF THE INVENTION

1. Field of the Invention

The present invention relates to a jet air flow crusher, and particularly to a jet air flow crusher which can crush, break or grind powder grains by using jet air flows.

1. Description of the Related Art

Conventionally, jet air flow crushers have been widely used, because they are easier to maintain and operate than other types of crushers and they are very adaptable to air flow classifiers to which they are connected.

Furthermore, they have been considered to be very useful for crushing various types of powder having a low heat resistance (for example, plastic powder), because they do not produce any significant heat during their operation. These jet air flow crushers have been used not only to crush various types of powder in a narrow sense, but also to break any agglomerate of powder grains, or to remove foreign matters sticking to the surfaces of powder grains.

Various types of jet air flow crushers have been known such as those wherein nozzles are installed, for example, in a cylindrical wall to jet air from the cylindrical wall in an inward and tangential direction so as to direct the powder grains with the jet air along the inside surface of the cylindrical wall and to cause collisions between the powder grains (hereinafter referred to as "turning flow type"), wherein nozzles to jet air to carry powder grains are inwardly opposed to each other so as to enhance the collision force between powder grains (hereinafter referred to as "opposed crushing nozzle type"), wherein jet air to carry powder grains is blown against the surface of a hard wall (hereinafter referred to as "object collision type"), and wherein jet air is blown out through the partial wall of a gas phase flowing passage in the form of an ellipse and carry powder grains in the gas phase flowing passage so as to cause collisions between powder grains for crushing them (hereinafter referred to as "jet O-mizer" type).

However, these types of crushers devised or practically used have prevented several problems to solve.

For example, the "turning flow" type crushers, though applicable to the crushing processes for very small quantities of powder, present a disadvantage in that due to the construction of the mechanism to remove crushed particles from the center part of the turning air flow (generally called "classifying mechanism"), an equivalent quantity of large-sized or coarse particles is also removed with fine particles, and thus they do not possesses a sufficient industrial processing capacity. The "opposed crushing nozzle" type crushers present problems is that they are effective on only 10 μm or more powder particles between which collisions take place. The "object collision" type crushers also present problems with respect to durability and contamination of foreign matter, because they cause wear of the wall against which the powder grains strike.

The "jet O-mizer" type crushers which can be provided with any apparatus for efficiently removing crushed powder particles having a uniform distribution of grain sizes. However, this type of crusher offers a problem in that it cannot sufficiently provide fine sizes of crushed powder grains thereby having a limitation in its applications.

SUMMARY OF THE INVENTION

An object of the present invention is to eliminate various problems presented by the conventional jet air flow crushers as described above.

Another object of the present invention is to provide a jet air flow crusher which can efficiently produce powder particles having a size of approximately 10 μm or less.

A further object of the present invention is to provide a jet air flow crusher which is small, has a simple construction and operates very well.

The jet air flow crusher according to the present invention comprises a guide face formed by the inside surface of an outer wall in which a flat and almost ellipsoidal internal space is defined to guide an ellipsoidal gas phase flow carrying powder grains; a crushing zone in which flowing powder grains are crushed provided on one side of the internal space in the direction of the ellipsoidal major axis; a classifying zone at which flowing powder grains are discharged on the other side of the internal space in the direction of the ellipsoidal major axis; a gas phase flow passage defined, in the crushing zone, by the inside furnace of the outer wall and a partition wall, and nozzles installed in the outer wall and the partition wall at several locations in the direction of the powder grain flow in the crushing zone to jet out air in a direction substantially corresponding to the powder grain flow for carrying and crushing the powder grains, and is characterized by the fact that in the crushing zone, a flow resisting means to limit the gas phase flow carrying the powder grains is also installed at least at one location between the nozzles spaced from one another in the direction of the powder grain flow.

The inventors have developed the present invention for the following reasons.

To provide such a type of jet air flow crusher to crush powder grains carried in a gas phase flow, it has been desired to effectively satisfy the requirements of crushing powder grains efficiently with a great crushing force in the crushing zone and separating and removing fine grains in a mixture of small and large powder grains in the classifying zone. To embody the requirements of the crusher, it has been desirable and possible to employ a crushing zone in which the fluidity of powder grains is limited to cause the powder grains to remain as long as possible and a classifying zone in which the fluidity of powder grains is sufficiently increased to improve the classifying effect on the powder grains involved in the gas phase flow. Thus, the present invention has been devised by the inventors.

Therefore, the present invention comprises a flow resisting means which limits the fluidity of powder grains in the crushing zone, and a means which increases the fluidity of powder grains in the classifying zone (hereinafter referred to as "fluidity amplifying means"). The fluidity amplifying means is often and preferably composed of, for example, the means which blows in air to increase and amplify the fluidity of powder grains between the crushing zone and the classifying zone which are separately defined on opposite sides of the space defined by an almost ellipsoidal partition wall.

In the crusher according to the present invention, the flow resisting means which limits the fluidity of powder grains in the crushing zone functions as a weir against the powder grains carried in the gas phase flow. Specifically, the flow resisting means may be preferably a means which limits a flow passage mechanically and structurally (or a throttle means), or a means which inhibits the flow of a gas phase carrying powder grains by blowing air into the gas phase carrying powder grains in a direction almost perpendicular to the gas phase.

The postion and direction in which powder grains are loaded into the crusher thus constructed may be set properly so that the powder grains will be able to flow in and together with the almost ellipsoidal gas phase flow. In general, it is often desirable that a powder loading inlet be placed in the passage where powder grains flow from the classifying zone to the crushing zone. However, the present invention is not limited to such.

According to the present invention, the casing which defines an internal space in which powder grains flow to be crushed and classified is almost an ellipsoidal. It is understood that the casing need not have the shape of an ellipsoid in the strict sense.

BRIEF DESCRIPTION OF THE DRAWING

FIG. 1(*b*) is a front sectional view of the crusher.

DETAILED DESCRIPTION OF THE PREFERRED EMBODIMENTS

Figure 1A:
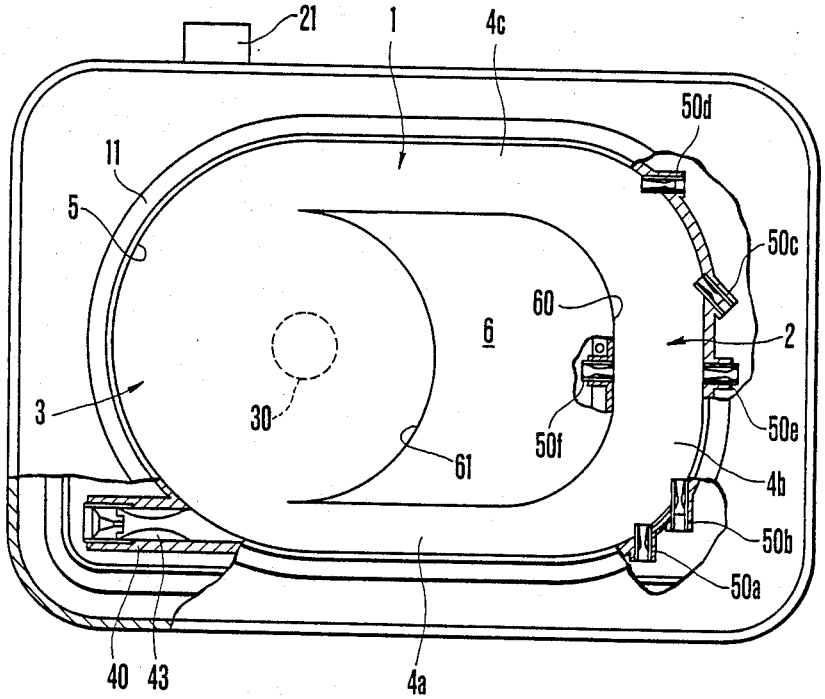
FIG. 1(*a*) is a plan view partially cross-sectional, illustrating the jet air flow crusher according to the present invention.

The present invention will be described below by referring to the drawings annexed hereto.

Figure 1B:
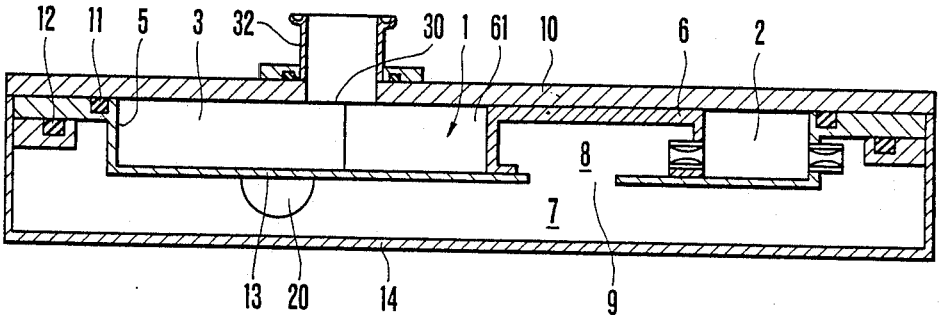

FIGS. 1(*a*) and 1(*b*) illustrate an embodiment of a jet air flow crusher according to the present invention. In this figure, 1 designates internal space in which powder grains are carried in a gas phase flow.

The internal space 1 is almost horizontal, has a flat ellipsoid shape, and is confined impermeably by an outer gas phase flow guide wall 5 (hereinafter referred to as "outer wall") which defines the ellipsoidal space 1 and forms the passage of powder grain flow with a bottom plate 13 and a top cover 10. Two seal rings 11 and 12 perfect the impermeable confinement of the internal space 1.

In the internal space 1, a central partition block 6 is formed as shown in the figure to contribute to separating a crushing zone 2 and a classifying zone 3 from each other and defining the two zones in preferred forms. In the crushing zone 2, the central partition block 6 has an internal gas phase flow guide wall 60 extending parallel to the outer wall 5. A gas phase flow passage 4*b* in which powder grains are carried in a gas phase flow is defined by the internal gas phase flow guide wall 60 and the outer wall 5. In the classifying zone, the central partition block 6 has an internal turning flow guide wall 61 for a classifying mechanism which removes fine powder grains in the turning flow at its center part.

Between the crushing zone 2 and the classifying zone 3, the outer wall 5 and the central partition block 6 define two other gas phase flow passages 4*a* and 4*c*.

Outside the internal space 1 enclosed by the outer wall 5, a compressed air chamber 7 is provided which is isolated with respect to pressure from external space 1 by the partition bottom plate 13, the outer wall 5 and the central partition block 6, and from the exterior by a pressure chamber casing 14.

The compressed air chamber 7 is connected to an external compressed-air source (not shown), for example, an air compressor, through a compressed air pipe 21 connected to a compressed air intake 20, and open the internal space 1 through air flow jet nozzles 50*a* to 50*e* as described hereinafter so as to introduce compressed air into the internal space 1.

The compressed air chamber 7 is also connected to another compressed air chamber 8 in the central partition block 6 through a penetrating hole 9 so that compressed air may be blown into the internal space 1 through jet air flow nozzles 50*f* as described hereinafter.

The powder loading mechanism in the crusher according to this embodiment is constructed as shown in FIGS. 1(*a*), 2 and 5(*a*). At the location at which the classifying zone 3 is connected to the gas phase flow passage 4*a*, a powder jet nozzle 40 is provided which has an outside end connected to the compressed air chamber 7 and an inside end connected to the gas phase flow passage 4*a*. The central top part of the powder jet nozzle 40 is connected with the lower end outlet 41 of a powder supply hopper 42 mounted on the top part of the top cover body 10 so that the powder supplied by the hopper 42 can be blown into the internal space 1 under of an ejector effect, while compressed air is blown from the compressed air chamber 7 into the internal space 1 through the nozzle 40. A diffuser 43 is disposed in the internal passage of the nozzle 40.

The powder supplied by the hopper 42 is jetted by the nozzle 40 into the gas phase flow passage 4*a* in the longitudinal direction as shown in FIG. 1(*a*).

Figure 2:
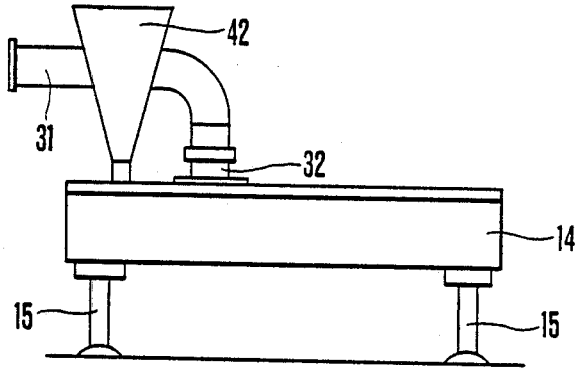
FIG. 2 is a front view of the crusher.

As shown in FIG. 2, legs 15 support the pressure chamber casing 14. Except for the legs 15, all the components of the crusher are generally made of a slick-surface-finished material such as stainless steel. Ceramic material may be used when powder grains having a higher abrasiveness are to be crushed.

Figure 4:
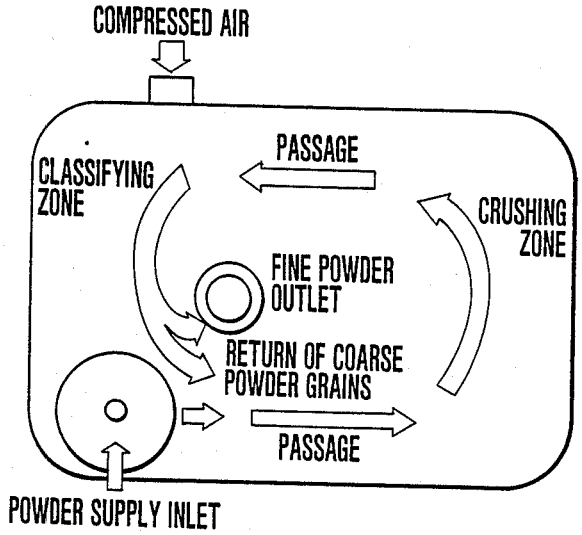
FIG. 4 is a schematic view illustrating the flow of powder grains in the crusher.

FIG. 4 illustrates the flow of powder grains in the internal space 1. The specifics of the crushing zone 2 and the classifying zone 3 will be described below by referring to FIG. 4.

In this embodiment, the crushing zone 2 is constructed as shown in FIG. 1(*a*). Along the gas phase flow passages 4*a* to 4*c* in the form of an arc in which powder grains are carried in a gas phase flow, the first to fourth air jet nozzles 50*a* to 50*d*, which blow jet air into the passages 4*a* to 4*c* approximately in the direction of the flow of powder grains and carrier gas, are disposed in the outer wall 5 at a predetermined spacing. Each of these nozzles 50*a* to 50*d* has an outside end facing the compressed air chamber 7 and an inside end facing the gas phase flow passage 4*b* or 4*c* so that compressed air is jetted from the compressed air chamber 7 into the gas phase flow passage 4*b* or 4*c* through each of the nozzles 50*a* to 50*d*.

Figure 5A:
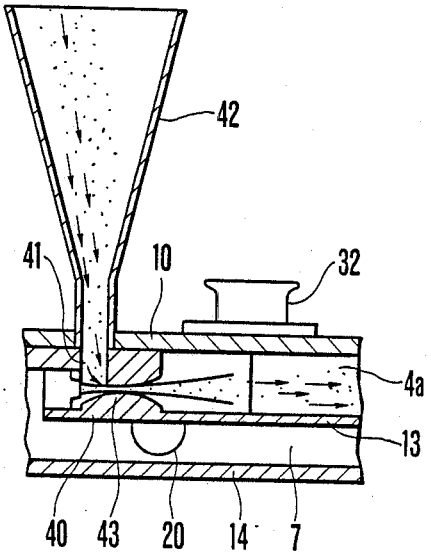
FIGS. 5(*a*) to 5(*c*) are partial sectional views illustrating the flow of powder grains in parts of the crusher.
Figure 5B:
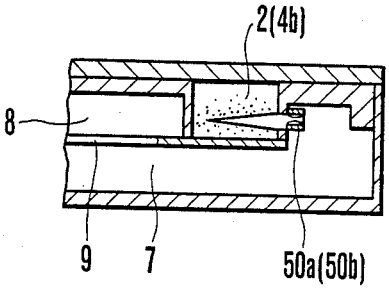
Figure 5C:
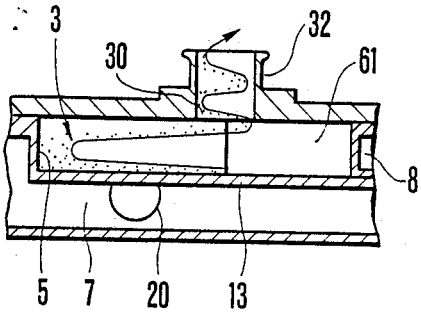

In each of these nozzles 50*a* to 50*d* as in the powder jet nozzle 40, is a diffuser which adjusts the velocity of the compressed air jet so that flowing powder grains will be effectively crushed by collisions therebetween caused by the air jetted out by the nozzles 50*a* to 50*d* in the directions described above. FIG. 5(*b*) shows the conditions in which powder grains in the jet air flow collide against each other.

This embodiment is characterized by the fact that in addition to the first to fourth jet air flow nozzles 50*a* to 50*d*, fifth and sixth jet air flow nozzles 50*e* and 50*f* are provided between the second and third jet air flow nozzles 50*b* and 50*c* and face each other at both sides of the gas phase flow passage 4*b* at such a setting angle that the air jetted out by the nozzles 50*e* and 50*f* flows approximately perpendicular to the longitudinal axis of the gas phase flow passage 4*b*.

The fifth and sixth jet air flow nozzles 50*e* and 50*f* are substantially identical construction to the other nozzles 50*a* to 50*d*, but let air in different air jet directions relative to the gas phase flow passage 4*b* from the compressed air chamber 7 into the gas phase flow passage 4*b* than do the latter.

Because the air jets from the fifth and sixth jet air flow nozzles 50*e* and 50*f* act as a type of weir (hereinafter referred to as "air flow weir"), the powder grains carried by the gas phase flow receive a resistance to their fluidity in the gas phase flow passage 4*b* so that they remain longer at the upstream position (on the side of the nozzles 50*a* and 50*b*) than they would if there were no air jets from the nozzles 50*e* and 50*f*. Therefore, the air jetted out from the nozzles 50*e* and 50*f* increase the opportunities for powder grains in the air jetted out by the nozzles 50*a* to 50*b* and clash against each other, and thus improve the crushing efficiency of the crusher according to the present invention.

The flow rate of jet air required to form the air flow weir may be controlled by changing the diffusers in the nozzles, or by regulating the pressure in each nozzle if an independent air source is used for each nozzle. The flow rate of jet air for the air flow weir depends upon the type and flow rate of powder to be processed. In general, it is often desirable that the flow rate of jet air from the nozzle 50*f* be set approximately $\frac{1}{3}$ to 3/2 the flow rate of jet air from the nozzle 50*a*.

On the downstream side of the air flow weir formed by the air jetted from the nozzles 50*e* and 50*f*, the air jetted from the jet air flow nozzles 50*c* and 50*d* provides opportunities at which powder grains may be crushed and again amplify the fluidity of the gas phase flow limited temporarily by the air flow weir so as to assure an effective classifying process in the classifying zone.

In this embodiment, the classifying zone 3 is constructed so that the powder grains introduced in the internal space 1 and carried into the classifying zone 3 through the crushing zone 2 will turn and flow along the outer wall 5 and the internal turning flow guide wall 61 and that the fine powder grains produced are discharged by the positive pressure in the internal space 1 to the exterior through the powder outlet 30 formed in the top cover 10 in the center part of the classifying zone 3.

Figure 3:
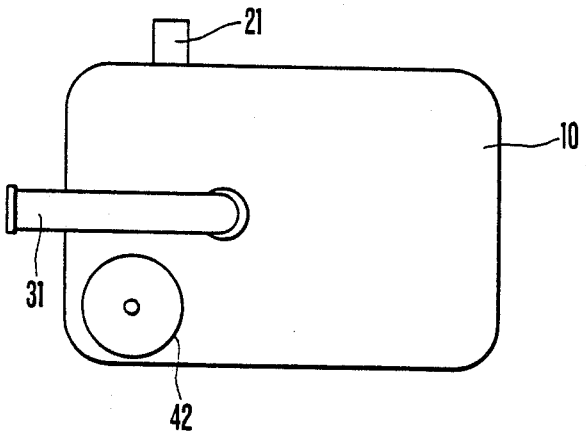
FIG. 3 is a plan view of the crusher.

In FIGS. 2 and 3, 31 designates an outtake pipe for fine powder grains, which is fixed on the top cover 10 through a flange 32 connected to the outtake pipe 31, and connected to a proper air flow type powder classifier disposed in the next process line.

The principle of the process of classifying and removing fine powder grains by using a turning flow method has been conventionally known wherein among the powder grains crushed, only the fine powder grains having small sizes are selectively removed based upon the relationship between the carrying force of the gas phase flow and the centrifugal force acting on the powder grains. To apply a classifying and taking-out mechanism based upon this principle to the crusher according to the present invention, this embodiment is characteristically designed so that the construction of the crusher can embody such a principle so as to improve the classifying efficiency.

Particularly, the crusher in this embodiment comprises nozzles (a powder jet nozzle 40 and a fourth jet air flow nozzle 50*d*) which are placed at the upstream end positions along the gas phase flow passages 4*a* and 4*c*, forming the linear parts of the ellipsoidal passage 4*a* to 4*c*, respectively, in the internal space 1, to jet air in order to improve the fluidity of the powder grains carried by the gas phase flow and to assure an effective flow of powder grains along the inside surface of the outer wall 5.

In this crusher, relatively large-sized powder grains (or coarse powder grains) in the classifying zone 3 are returned to the crushing zone 2 by the centrifugal force of the gas phase flow carrying powder grains acting at the outer part of classifying zone 3 that is greater than the carrying force of the gas phase flow acting at the center part of the classifying zone 3, whereby relatively small-sized powder grains (or fine powder grains) are discharged to the exterior through the fine-powder outlet 30. FIG. 5(*c*) shows the conditions where the fine powder grains are discharged to the exterior.

Several examples of test of the jet air flow crusher constructed as described above will be presented below:

EXAMPLES 1 AND 2

These tests were carried out graphite powder having the 50% average diameter $D_{50}=37.6$ μm compressed air of 6.0 to 6.2 kg/cm$^2$ introduced in the compressed-air chamber 7, and the total flow rate of air being 1.6 to 1.4 Nm$^3$/min (or the flow rate of air per 2 mm nozzle was 0.2 to 0.22 Nm$^3$/min).

The flow rate of powder to be processed was 2.5 kg/h to 25 kg/h.

All the nozzles 50*a* to 50*f* were full opened to jet out the air, respectively, in Example 1, while the sixth nozzle 50*f* was closed in Example 2.

Figure 6:
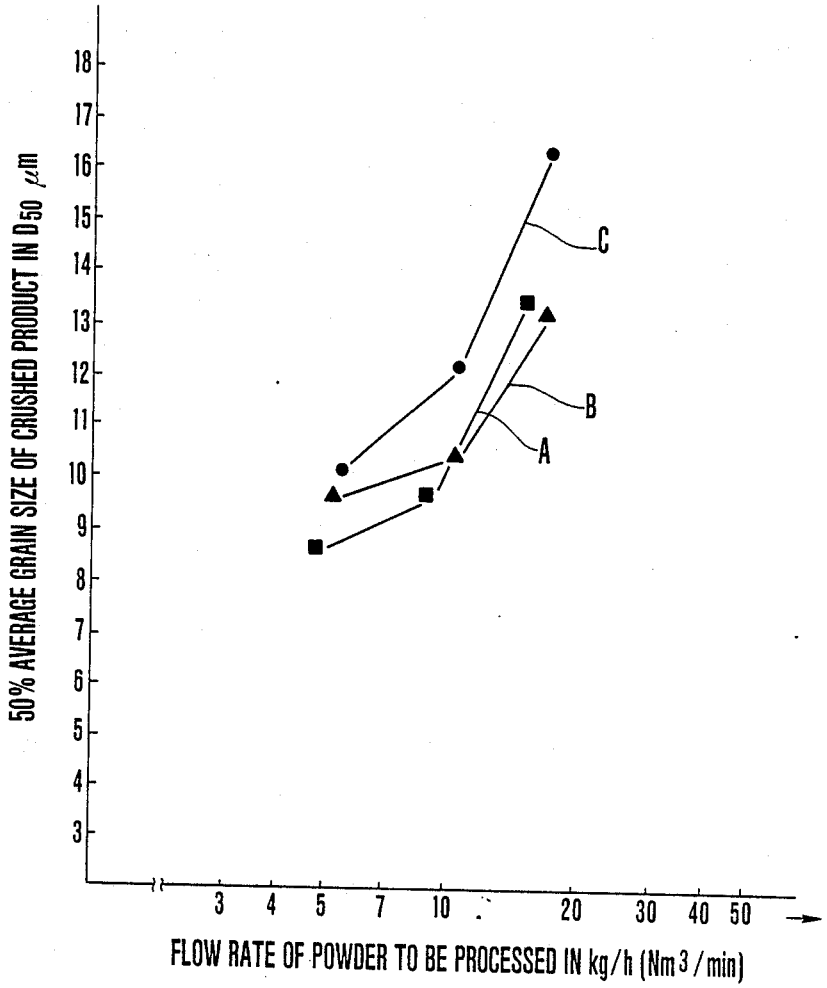
FIG. 6 is a graph showing the results of testing the crusher.

The results of these tests are as shown in FIG. 6, where A indicates Example 1, while B corresponds to Example 2.

COMPARATIVE EXAMPLE 1

This test was carried out under the same conditions as in Examples 1 and 2, except that the fifth and sixth nozzles 50*e* and 50*f* were closed to form no air flow weir. The result of this test is as shown by the line C in FIG. 6.

FIG. 6 shows that the formation of the air flow weir improved the crushing efficiency for powder grains and that the flow rate of powder to be processed was significantly higher in the embodiment of the present invention, if the same grain diameter of powder to be processed was used.

Figure 7:
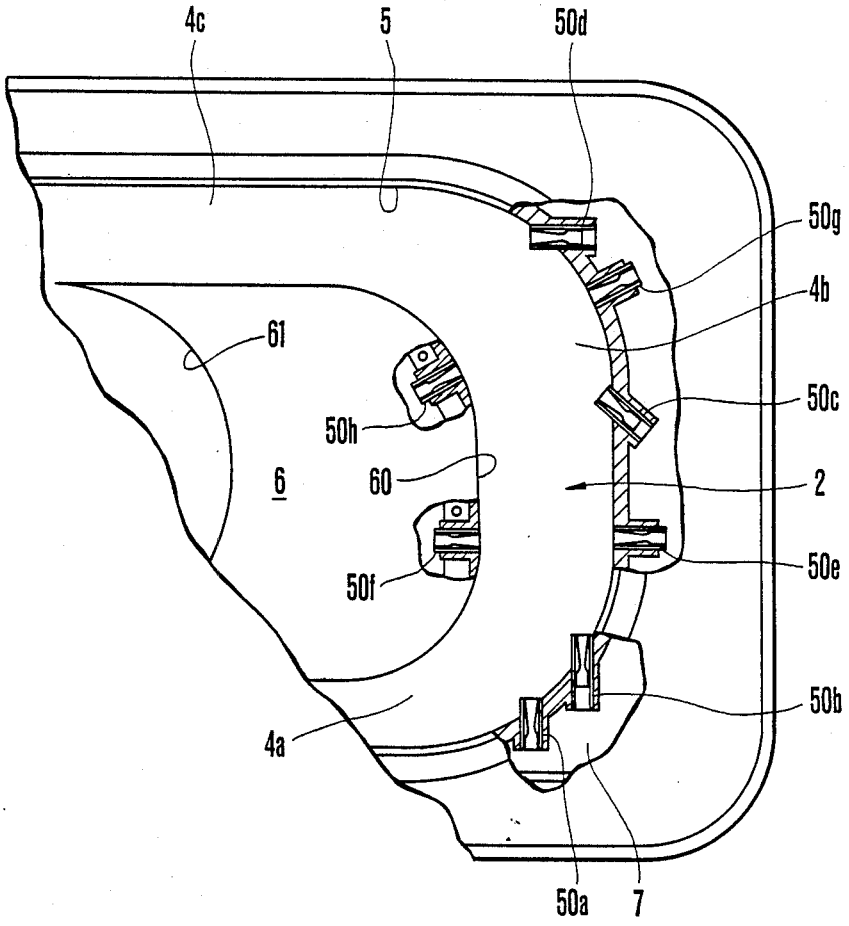
FIGS. 7 and 8 are partial plan views of jet air flow crushers according to other embodiments of the present invention, respectively.
Figure 8:
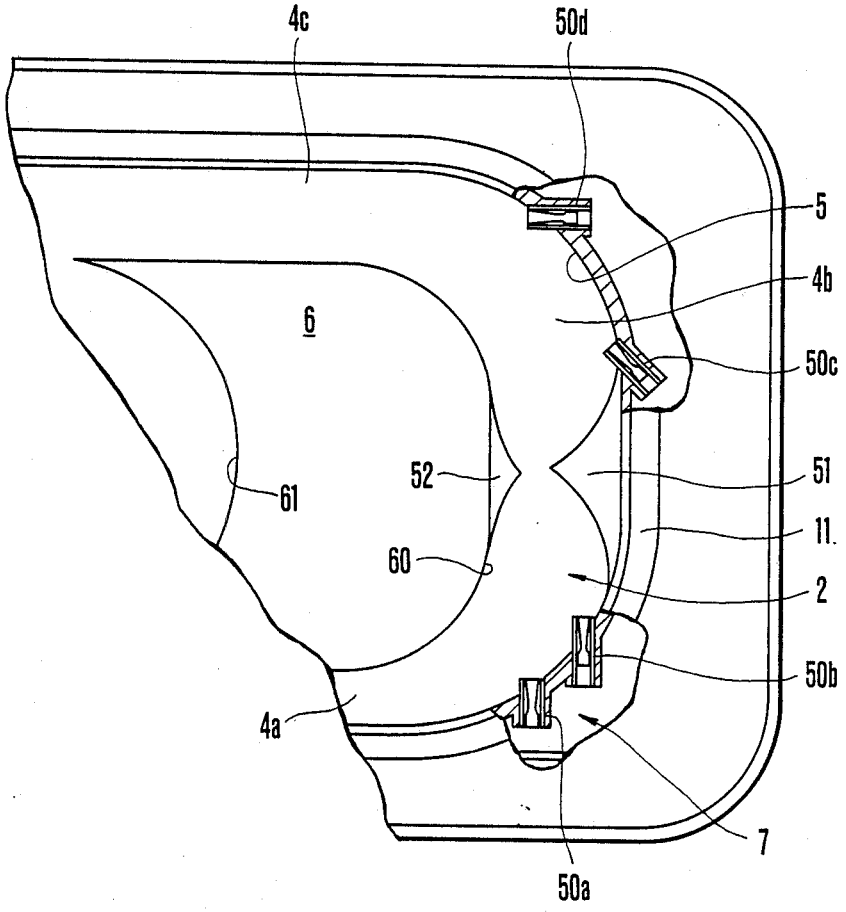

FIGS. 7 and 8 show the other embodiments of the present invention. The embodiment as shown in FIG. 7 has an almost identical construction to that shown in FIG. 1, except that two pairs of opposed nozzles (50*e*, 50*f* and 50*g*, 50*h*) are provided to form air flow weirs.

The embodiment as shown in FIG. 8 comprises a structural throttle to limit the flow rate of powder grains carried by the gas phase flow instead of the air flow weir. In the embodiment as shown in FIG. 8, a pair of angle blocks 51 and 52 opposing each other is placed at locations at which the opposed nozzles 50*e* and 50*f* were disposed in FIG. 1 so as to limit the gas phase flow passage 4*b* partially and, consequently, to serve as a weir to the powder grains carried by the gas phase flow.

The form of such a structural weir may be selected experimentally or experientially, or otherwise based upon the observation of powder grains flowing through the air flow weir.

As has been described above, the jet air flow crusher according to the present invention present advantages in that it eliminates various problems present in the conventional jet air flow crushers, that it has an excellent processing efficiency and is capable of providing a sufficient industrial processing capacity, even if relatively small-sized powder grains are crushed, and that it can provide crushed powder grains having a size of 10 μm or less on industrial production scale, while such grains could heretofore be conventionally provided only by a special crusher having a small processing capacity.

The crusher according to the present invention has a simple construction, is small and operates very well.

What is claimed is:

1. A jet air flow crusher for crushing powder grains, said crusher comprising:

an outer wall in which an internal space is defined;

powder grain introducing means open to said internal space for introducing powder grains therein;

a partition wall within said outer wall, said partition wall partitioning said internal space into a crushing zone and a classifying zone open to said crushing zone, said crushing zone defined and extending in a powder flow direction between an outer guide surface of said partition wall and an internal surface of said outer wall, said classifying zone comprising an outlet through which crushed powder grains are discharged from said internal space;

a plurality of nozzles open to said crushing zone, said nozzles spaced apart and directed in said powder flow direction, and said nozzles connectable to a source of compressed air for jetting air into said crushing zone in substantially said powder flow direction to cause the powder grains to be crushed in said crushing zone and to carry the powder grains from said crushing zone toward said classifying zone; and flow resisting means disposed in said crushing zone between respective ones of said plurality of nozzles for inhibiting the flow of powder grains in said powder flow direction from one of said respective ones of said plurality of nozzles to the other of said respective ones of said plurality of nozzles whereby powder grains accrue in the crushing zone at said flow resisting means prior to flowing to said other of said respective ones of said plurality of nozzles, said flow resisting means comprising nozzle means open to said crushing zone at a location between said respective ones of said plurality of nozzles, directed perpendicular to said powder flow direction, and connectable to a source of compressed air flow for directing a jet of air into said crushing zone in a direction perpendicular to said powder flow direction, and said other of said respective ones of said plurality of nozzles disposed, in said powder flow direction, between said flow resisting means and said classifying zone.

2. A jet air flow crusher for crushing powder grains as claimed in claim 4, wherein said outer wall has an elliptical inner surface whereby said internal space is ellipsoidal, said crushing zone being defined on one side of said internal space in a direction corresponding to a major axis of said ellipsoidal inner space, and said classifying zone being defined on the other side of said ellipsoidal internal space.

* * * * *